United States Patent [19]

Natvig et al.

[11] 3,977,346

[45] Aug. 31, 1976

[54] DECK STRUCTURE AND METHOD FOR BUILDING SAME

[75] Inventors: Birger Johannes Natvig; Per Christian Sandnaes; Per-Gustav Lindeberg, all of Oslo; Olaf Salvesen, Blommenholm, all of Norway

[73] Assignee: A/S Akers Mek. Verksted, Oslo, Norway

[22] Filed: July 1, 1974

[21] Appl. No.: 484,794

[30] Foreign Application Priority Data

July 5, 1973 Norway ..... 2763/73

[52] U.S. Cl. ..... 114/65 R; 61/87; 114/.5 D

[51] Int. Cl.[2] ..... B63B 9/00

[58] Field of Search ..... 114/85, 43.5, 65 R, 114/65 A, 77 R, 77 A, .5 R, .5 D, 44, 45, .5 F; 61/46.5

[56] References Cited

UNITED STATES PATENTS

| | | | |
|---|---|---|---|
| 2,352,370 | 6/1944 | Carruthers | 61/46.5 |
| 2,689,460 | 9/1954 | Wilson | 61/46.5 |
| 2,924,947 | 2/1960 | Peterson | 61/46.5 |
| 2,959,015 | 11/1960 | Beck | 114/.5 D |
| 3,036,539 | 5/1962 | Storey | 114/.5 F |
| 3,073,274 | 1/1963 | Lamb | 114/.5 F |
| 3,165,211 | 1/1965 | Ablett | 114/85 |
| 3,464,212 | 9/1969 | Yamagata et al. | 114/65 A |
| 3,688,719 | 9/1972 | Amirikian | 114/.5 F |
| 3,797,438 | 3/1974 | Fayren | 114/77 R |

*Primary Examiner*—Duane A. Reger
*Assistant Examiner*—Charles E. Frankfort
*Attorney, Agent, or Firm*—Watson, Cole, Grindle & Watson

[57] ABSTRACT

A deck structure is assembled on a base structure which extends upwardly out of a body of water and is supported on the bottom of the water body. The deck structure is separately constructed as a self-supporting horizontal unit at a building site such as a pier, and floating barges are provided for supporting the deck structure outwardly of the building site. The deck structure is thereafter transferred to the base structure by means of the barges.

13 Claims, 3 Drawing Figures

DECK STRUCTURE AND METHOD FOR BUILDING SAME

BACKGROUND OF THE INVENTION

The invention relates to a method for building a deck structure which is supported by a base structure which is floating or resting on the sea bottom, said deck structure being built separately and thereafter transferred to said base structure.

Such platform decks, hereinafter also called decks, have previously been constructed on the field in open sea when the supporting structure, for instance columns or the like, have been arranged on the sea bottom and extending upwardly above sea level to a suitable height for placing the platform deck. Erecting the deck in place is time consuming and difficult work since all the component parts of the deck first must be brought to the field on barges or the like and then mounted in place on top of the columns by means of floating cranes or the like and, thereafter, upon completion of erection, the deck is furnished with the necessary mechanical equipment, quarters for the crew, etc. and this equipment also has to be transported to the field by means of barges or the like and lifted in place on the deck by means of floating cranes or the like. Bad weather often forms obstacles for such operations which therefore can extend over impredictable periods of time and lead to great expense in the form of lost production and increased building costs.

Prefabricated units, so-called "pre-packets" are now more commonly used and these units contain generally connected machinery, equipment, crew quarters etc. mounted and equipped on land in order to be freighted to the field on barges during good weather conditions and lifted up on deck by means of floating cranes.

The weight of such a unit can be as high as 1400 tons or more and therefore require crane lifting capacities that are available only to a very limited extent. In addition, good weather conditions including low wind velocity and relatively calm sea conditions is an absolute prerequisite also for performance of this work.

The equipment required on a production platform is very extensive and complex. It may for instance comprise drilling equipment for the drilling of holes in different directions from the platform, extensive production machinery such as pumps and compressors, separation plants for the separation of oil and gas, other processing equipment for condensation and fractination of gas and storage facilities for products and necessary supplies. In addition, facilities for the crew, power machinery, communication equipment and the like are required.

The bulk of this equipment must be installed accurately and carefully. Thereafter it is to be made ready, controlled and test run, and this work requires a lot of time and substantial assistance from technical experts which, like the rest of the workforce, need quarters and require extra pay to work on a platform out in the ocean.

A further drawback associated with the mounting of pre-packets and other equipment on a platform deck is that the equipment is exposed to the destructive forces of weather, wind and sea. In addition, the equipment can easily be subjected to damage during the relatively difficult installation conditions usually prevailing on such a platform.

In Norwegian patent application Ser. No. 2202/71, a method is described for building a semi-submergible drilling platform where the upper platform in the traditional way is to rest on top of columns supported by floating units. The upper platform is built of two parallelepipedical bodies arranged on base blocks serving as skids during launching the same way a ship is launched from a slipway or the like. The parallelepipedical floating bodies are fixed to the upper platform and are consequently intended to follow the platform after it has been arranged on the floating body. The upper platform is thus constructed on the slipway in an inclined position so that only a few parts, such as the drilling tower, can be mounted on the deck before the platform is brought to a floating position.

The method in accordance with Norwegian patent application Ser. No. 2202/71 does require two building sites which necessitate a certain duplication of cranes and other construction equipment. The parallelepipedical floating bodies also add to the cost, i.e. because they are permanently fixed to the platform.

Another substantial drawback associated with this method is that the platform is not supported on the same points during construction as it is after installation on the floating units. Since there always will be a substantial deflection in such a large structure due to its own weight and installed equipment, the platform will change its form when it is transferred from one set of supporting points to another. Equipment having strong requirements as to accuracy of alignment while previously being installed will have to be aligned over again after the final supporting of the platform. In addition, the very strong requirements as to the stability, rigidity, and watertightness of a production platform cannot be fulfilled by a structure in accordance with Norwegian application No. 2202/71.

SUMMARY OF THE INVENTION

The invention aims at providing a method by which a platform deck for a production structure of the previously mentioned kind may be made in a novel and favorable manner whereby all the previously mentioned drawbacks are eliminated. This is done by giving the platform deck the form of a self-supporting unit comprising also all or the major part of the mechanical equipment, etc., said unit being built and equipped on a building site comprising a pier, islet or the like permitting the completed unit to be built in a horizontal position and transferred to the support of barges or the like without being moved from the building site and without being launched. These barges are used in a way know per se for transporting the deck unit to the site of the base construction where the deck unit is transferred to the upwardly extending columns or the like of the base construction without being launched by changing the draught of the barges and/or the base construction, jacks, tide or other suitable means.

If the relative sizes permit, the deck may be constructed on a floating dock for eventual transfer to barges as mentioned above or by the use of the floating dock during the entire operation. Such a technique may be advantageous where greater elevation differences exist between the top of the columns of the base structure and sea level.

By such method only a minimum of heavy cranes and other equipment are necessary in the field. When the platform is installed on the base structure, production may immediately commence. The arrangement of the base structure and the platform become two completely independent operations. Thus the two parts of the installation may be made as separate units in different places but possibly concurrently so that substantial total construction and installation time is saved. By building the deck unit ashore, all installation of equipment may be performed under proper direction and control independently of weather conditions and in a place where cranes and similar equipment already exist, i.e., in a shipyard.

By such methods the necessity of heavy and costly floating cranes and other such equipment on the field is eliminated in addition to a great reduction in the considerable transport of equipment etc. from shore to the field.

When a platform deck is constructed in the usual way on the supporting structures on the field and the mechanical units or prefabricated units thereafter are installed, the distortions that invariably occur will have to be adjusted by adjusting each unit for correct alignment, such adjustments being especially complicated when the weights amount to 1400 tons or more.

By making the deck in accordance with the invention as a unit that also comprises the complete equipment and machinery already installed, levelled and aligned on their respective bases arranged on and in the unit while it is in the construction site, will make later adjustments on the field unnecessary. The entire deck unit is thus adjusted with respect to proper position during its construction on its supporting columns or the like. Any adjustments of the deck is performed by hydraulic jacks placed for instance in a suitable relative distance around the periphery of the columns of the base structure in co-operation with corresponding abutments arranged on the bottom side of the deck. The abutments preferably extend downwardly from the bottom side of the deck to a suitable distance from the deck in order to facilitate adjustment and attachment to the columns.

BRIEF DESCRIPTION OF THE DRAWINGS

To further clarify the invention it shall be described in the following with reference to the embodiment schematically shown in the drawing.

DESCRIPTION OF THE PREFERRED EMBODIMENT

Figure 3:
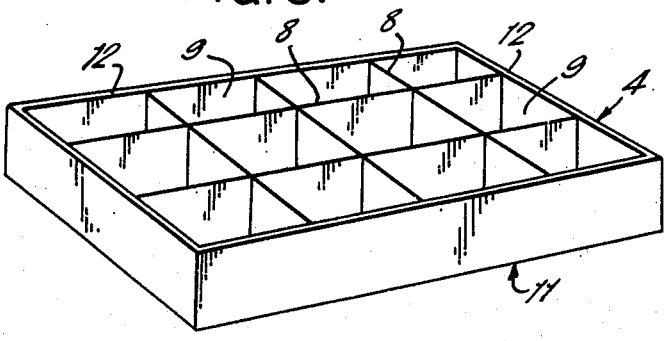
FIG. 3 shows a schematic perspective view of a preferred embodiment of a deck unit.

The deck unit 4 can be constructed as suggested in FIG. 3 as a parallelepipedic box-like structure subdivided into sections 9 by means of intersecting partitions 8 which concurrently are supporting girders or frame plates. The girders 8 together with side girders 12 form the supporting main structure. The bottom and the sides of the unit are closed while the unit may be upwardly open. The necessary mechanical equipment is installed in the different sections 9 and living quarters, etc. are arranged. The sections are then closed by suitable deck plates or lids that may be disassembled for later access to the separate sections if, for instance, machinery is to be replaced.

Each section 9 is preferably closed at the bottom by a continuous bottom plate 11 on which the girders 8 and 12 are built up, and the bottom plate 11 thus forms part of the supporting structure. In the girders, which form separating walls between the sections 9, the necessary openings are made for internal communication. Likewise, openings are made in the side girders 12 if necessary.

Figure 1:
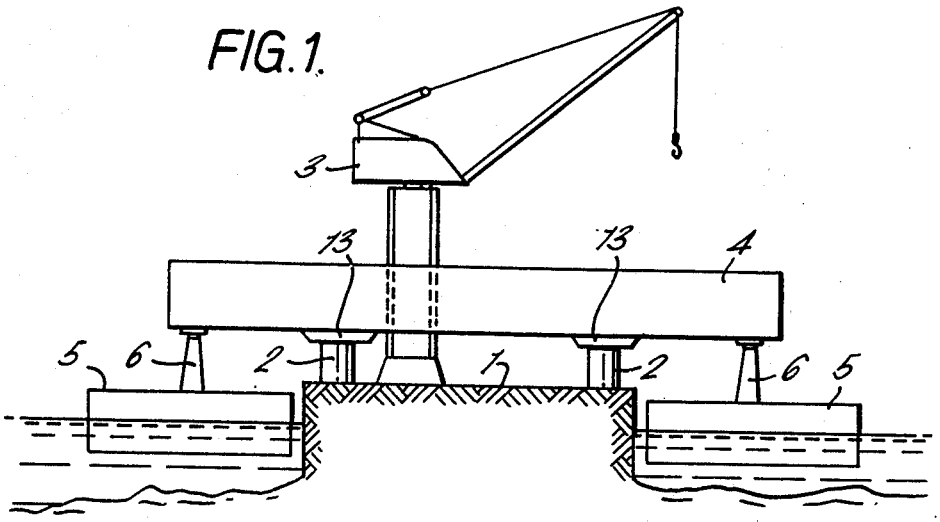
FIG. 1 shows a side view of a deck unit during the first stage of construction.
Figure 2:
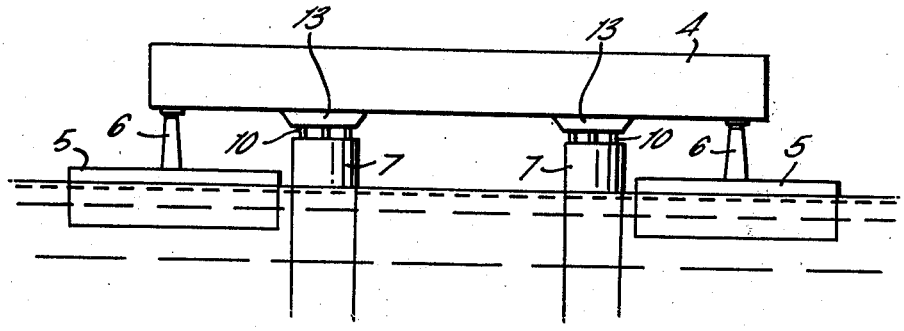
FIG. 2 shows the deck unit during a later stage of construction in which it is mounted on the supporting columns of the base structure.

The pier 1 is so arranged that the deck unit 4 extends from the sides of the pier on both sides. When the unit 4 is finished, barges 5 may therefore be brought in under the ends of the unit as shown in the drawing, and by means of supports 6 and suitable lifting means and/or changes in the buoyancy of the barges 5, may be brought to lift the deck unit 4 up and away from the blocks 2 and carry the unit 4 away from the pier. In this position the deck unit 4 may be towed to the installation location, that is, to the upwardly extending columns 7 of the base structure, by means of the barges 5. This is shown in FIG. 2. The unit 4 is here transferred by suitable means to rest on top of the columns 7 which extend upwardly from the base structure. The transfer may take place in the same way as the transfer from the pier 1 in that the barges 5 change buoyancy and/or by hydraulic jacks, tide or in other suitable ways. It is also possible to lift the unit 4 off the barges by raising the base structure.

Between the deck unit 4 and the top of the columns 7 it is advantageous to arrange adjusting means 10 in order to level the deck unit 4 after installation or readjust the position of the unit if it later were to change.

It is important in accordance with the invention that the position of the supporting blocks 2, the support points 13 and the columns 7, correspond to each other. Thus the deflection of the girders 8 and 12 which arise when the deck 4 is loaded by its own total weight, equipment etc. will be unchanged after the deck 4 is installed on the columns 7.

The support points 13 have dimensions comparable to the columns 7 and at least one of the support points 13 can be arranged to have drill strings extend through it for ground drilling or the like. Portions of support points 13 extending beneath bottom plate 11 are cut out a suitable distance from the bottom in order to facilitate access during connection to the columns 7.

A further important aspect of the invention is that the blocks 13 forming the mounting base for the construction of the deck structure are located in an exactly horizontal position in order to facilitate expedient and correct installation of all the equipment.

The method shown in the drawing and described above can be varied in several ways within the scope of the invention. Thus the deck unit 4 may be built in a dock and transferred from this to the transport barges. Likewise, the deck unit may be made in two main sections which separately are transported to the installation site and there connected to the columns or other parts extending from the base structure.

We claim as our invention:

1. A method of constructing an off-shore deck structure capable of being transferred to and supported by a base structure positioned within a body of water, the method comprising: selecting a building site surrounded on at least two sides by water; arranging supporting members on the building site; constructing the deck structure in a substantially horizontal orientation on the supporting members; and, connecting floatation members to lateral ends of the deck structure and the floatation members extending into the water so as to enable the deck structure to be removed from the building site, while leaving the floatation members in the water, and transferred to a location at which it is to be utilized.

2. The method as defined in claim 1, wherein the floatation members are barges and the barges are connected to the deck structure during its construction so as to provide further support for the deck structure as it is being constructed.

3. The method as defined in claim 1, further comprising the step of installing equipment on the deck structure while it is still located at the building site.

4. The method as defined in claim 1, wherein both said supporting members and said floatation members are aligned along a single axis and located in the same relative positions with respect to the deck structure.

5. The method as defined in claim 1, further comprising connecting additional support members between the deck structure and the support members, the additional support members being adjustable in height for adjusting the level of the deck section.

6. The method as defined in claim 1, wherein the deck structure is constructed in the form of a box subdivided into sections by partitions and being covered by removable top deck plates for rendering the sections accessible from above.

7. An off-shore deck structure capable of being constructed at a building site surrounded by water on at least two sides and transferred to a base structure located in a body of water and including vertical columns extending upwardly out of such body of water, the deck structure comprising: a self-supporting structure including sidewall girders, intersecting girders, support elements fixed to said intersecting girders of said self-supporting structure, and said girders forming partitions for the reception of machinery and other equipment; each of the lateral sides of said deck structure being connected to a floatation member, each said floatation member extending into the water, so that said deck structure can be transferred from the building site to the base structure while leaving said floatation members in the water; and said support elements being mounted on top of support members for supporting the deck structure at the building site and being detachable from such support members so as to be capable of being similarly mounted on support members in the location of the base structure so that the support members are coupled to the deck structure at the same positions when the deck structure is located in both locations.

8. A deck structure as defined in claim 7, further comprising: additional support members attached between the support members and said intersecting girders, said additional support members being adjustable in height for leveling said deck structure both at the location of the building site and at the location of the base structure.

9. A deck structure as defined in claim 7, wherein said self-supporting structure further includes a bottom plate integrated with the bottom edges of both said sidewall girders and said intersecting girders.

10. A deck structure as defined in claim 7, wherein said partitions are open along their upper edges and are closed along their bottom edges.

11. A deck structure as defined in claim 10, wherein removable plates are provided for covering said self-supporting structure at said upper edges of said partitions.

12. A deck structure as defined in claim 7, wherein said support elements are integrated with said intersecting girders.

13. A deck structure as defined in claim 7, further comprising: barges provided beneath the deck structure and vertical supporting members on said barges serving to support opposite sides of said deck structure.

* * * * *